US006487751B2

(12) United States Patent
Renaud

(10) Patent No.: US 6,487,751 B2
(45) Date of Patent: Dec. 3, 2002

(54) DOOR SAFETY DEVICES

(76) Inventor: Regis P. Renaud, P.O. Box 792, Silverado, CA (US) 92676-0792

( * ) Notice: Subject to any disclaimer, the term of this patent is extended or adjusted under 35 U.S.C. 154(b) by 97 days.

(21) Appl. No.: 09/789,978

(22) Filed: Feb. 20, 2001

(65) Prior Publication Data

US 2001/0044985 A1 Nov. 29, 2001

Related U.S. Application Data

(60) Provisional application No. 60/183,510, filed on Feb. 18, 2000.

(51) Int. Cl.[7] ..... E05F 5/02

(52) U.S. Cl. ..... 16/83; 16/86 A; 292/288; 292/DIG. 15

(58) Field of Search ..... 16/83, 82, 86 R, 16/86 A, 86 B; 292/258, 288, DIG. 2, DIG. 15, DIG. 19

(56) References Cited

U.S. PATENT DOCUMENTS

| | | | | | |
|---|---|---|---|---|---|
| 1,336,527 | A | * | 4/1920 | Lewis et al. | 16/86 A |
| 1,520,199 | A | * | 12/1924 | Morgan | 16/86 A |
| 1,929,494 | A | | 10/1933 | Horlick, Jr. | |
| 2,829,712 | A | | 4/1958 | Quinn | |
| 3,200,434 | A | | 8/1965 | Jarnot | |
| 3,335,453 | A | | 8/1967 | Lovelace | |
| 3,427,776 | A | | 2/1969 | Lake et al. | |
| 3,526,733 | A | | 9/1970 | Troll | |
| 3,827,739 | A | * | 8/1974 | Overholser | 292/DIG. 2 |
| 4,004,372 | A | | 1/1977 | Beard et al. | |
| 4,165,553 | A | | 8/1979 | Salerno | |
| 4,208,841 | A | | 6/1980 | Starks | |
| 4,304,071 | A | | 12/1981 | Obrecht | |
| 4,532,743 | A | | 8/1985 | Miller et al. | |
| 4,591,148 | A | * | 5/1986 | Slater | 292/DIG. 15 |
| 4,770,450 | A | | 9/1988 | Dacus | |
| 5,004,279 | A | | 4/1991 | Radcliff | |
| 5,074,073 | A | | 12/1991 | Zwebner | |
| 5,123,685 | A | | 6/1992 | Donovan | |
| 5,288,257 | A | | 2/1994 | Zacherl | |
| 5,291,631 | A | | 3/1994 | Schjoneman | |
| 5,450,652 | A | | 9/1995 | Webb | |
| 5,711,557 | A | | 1/1998 | Nicolosi | |
| 5,873,146 | A | | 2/1999 | Mungo et al. | |
| 5,887,917 | A | | 3/1999 | Luciana | |
| 5,983,570 | A | | 11/1999 | Brown | |
| 5,984,386 | A | | 11/1999 | Clemens | |

* cited by examiner

*Primary Examiner*—Anthony Knight
*Assistant Examiner*—Doug Hutton
(74) *Attorney, Agent, or Firm*—Knobbe, Martens, Olson & Bear, LLP

(57) ABSTRACT

Gravity actuated door safety devices, which prevent injury to fingers and pet's tails, are provided. A swinging door safety device comprises a pair of spaced parallel bars connected to one another at one end by a crossbar. At the opposite end of each bar, a counterweight is provided. Each bar has a ring attached at a point between the first and second ends. With the rings mounted to oppositely facing door knobs such that the crossbar spans the leading edge of the door, gravity acting on the counterweight biases the device to rotate such that the bars extend outward from the leading edge and prevent closure of the door by contacting the door jamb. The device is manually rotatable to a position wherein the bars do not extend forward of the door leading edge in order to fully close the door. A sliding door safety device comprises a mounting bracket secured near the leading edge of the sliding door. A lever is pivotally mounted to the bracket and rotatable between a stop position and a retracted position. Gravity acting on the lever automatically deploys the lever to the stop position when the door is opened due to the lever geometry.

4 Claims, 3 Drawing Sheets

DOOR SAFETY DEVICES

CLAIM OF PRIORITY

This application claims priority to U.S. Provisional Patent Application Ser. No. 60/183,510, filed Feb. 18, 2000.

BACKGROUND OF THE INVENTION

1. Field of the Invention

The present invention relates to safety devices for sliding and swinging doors. In particular, the present invention provides a gravity actuated apparatus for protecting fingers and tails of pets from being accidentally pinched between a door and a door frame.

2. Description of the Related Art

There are two basic types of doors: sliding and swinging. Both types of doors can pinch fingers and pets' tails if they are closed without adequate caution. Most doors have handles that are too high for children to reach, so they often grab the door by the leading edge of the frame in order to close it. Pulling the door closed in this manner puts the child's fingers in danger. Often when a pet sees a door closing they will race to get inside or outside before the door closes. This race often ends with the pet's tail caught between the door and the door frame. Such mishaps can be quite painful and can cause permanent damage.

Today's sliding glass doors can be especially dangerous, since many are quite heavy, having double paned windows and sliding very smoothly on low-friction tracks. Once these doors have begun to slide shut, it is often very difficult to stop them. To a hand or tail caught in the wrong place at the wrong time, the closing of one of these doors can be the equivalent of a guillotine.

To prevent accidents such as these, a safety device is required to stop the door from closing all the way. U.S. Pat. No. 4,165,553 to Salerno provides such a device. The invention comprises a support housing attached to a sliding door frame. The support housing pivotally supports a resilient body. When the door is in an open position, a gravitational force acting on the body moves the body into a position between the leading edge of the door and the frame. In this position, the body prevents the door from closing completely. The body is manually movable away from the door and frame so that the door may be closed. When released with the door closed, the body is positioned by gravitational force in abutment with the leading surface of the door. When the door is again opened, gravity moves the resilient body back into a position between the leading edge of the sliding door and the frame.

U.S. Pat. No. 3,335,453 to Lovelace provides another safety device for sliding doors. The device comprises a mounting bracket for positioning the device at the border between the door frame and the leading edge of the sliding door. The mounting bracket supports a spring-loaded plunger that is movable in a direction perpendicular to the plane of the door. In a first position, the plunger does not interfere with the closing of the sliding door. The spring, however, biases the plunger toward a second position wherein the plunger blocks the path of the sliding door, preventing its closure. In order to close the door an operator must manually hold the plunger in the first position while closing the door. Once the door is closed the plunger is released and rests against the leading edge of the closed sliding door. When the door is opened, the spring automatically moves the plunger to the second position wherein it again blocks the path of the door.

U.S. Pat. No. 3,200,434 to Jarnot provides a door closing preventer for swinging doors. The device comprises a freely hanging chain mounted at one end to a surface of the door frame. Attached to the free end of the chain is a resilient cigar-shaped bumper. The chain is positioned such that when the door is open, a portion of the bumper interferes with the closing of the door by blocking the path of the leading edge of the door. The bumper becomes pinched between the leading edge of the closing door and the door frame. In order to close the door, an operator must manually hold the bumper away from the door while closing the door.

U.S. Pat. No. 5,004,279 to Radcliff provides a door latch holder configured for use with a typical swinging door having one knob or handle on each side of the door. The door latch holder comprises a body configured to rest over the door latch, the body including a pair of loop-like strap attachments, each strap depending from opposite ends of the body. To install the door latch holder, one loop is wrapped around each door knob such that the intermediate body rests over the door latch and forces the latch into a retracted position. In this position, the door latch does not interfere with the opening or closing of the door. Thus, this device is not intended to prevent injuries caused by slamming doors. Rather, with this door latch holder properly installed, the door may be opened and closed without turning the knob.

U.S. Pat. No. 5,291,631 to Schjoneman provides a door stop for use with typical swinging doors. The door stop comprises a flexible rubber-like member shaped substantially as a flat dumbbell. Both enlarged ends of the door stop include a hole configured to fit about the opposed knobs or handles of a door. When properly installed, a thin strip connecting the two bulbous ends wraps around the leading edge of the door and prevents closure of the door.

While each of the devices just described is effective for its intended purpose, none of the devices are very easy to operate. The Schjoneman device, for example, can be very difficult to mount and dismount from the door knob. And the Jarnot, Lovelace and Salerno devices can be difficult, if not impossible, to manipulate from the side of the door opposite the device. With the Salerno device, for example, if the operator is not standing on the side of the door on which the device is mounted, he must reach between the frame and leading edge of the door in order to hold the device out of the way as he closes the door. Ironically, then, the Salerno device actually increases the likelihood that an operator will pinch his or her fingers between the sliding door and door frame.

Another type of device currently available for swinging doors comprises a wedge positioned on the door hinge, thereby preventing the door from closing by providing an obstruction between the hinged edge of the door and the door frame. In order to close the door, the wedge must be removed. Upon re-opening the door, the wedge must be manually repositioned on the hinge in order to reestablish the safety provided by the device. This procedure can be easily forgotten, making the door even more dangerous because the safety measure is assumed to be in place when, in fact, it is not.

Therefore, a device that prevents the full closing of sliding and swinging doors, that automatically deploys when the door is opened, such that an operator need not manually install the device, that is easily operable regardless of which side of the door the operator stands, and that is inexpensive to manufacture and costs consumers little to purchase or install, would be of great benefit in preventing injury to fingers, especially children's fingers, and pets' tails.

SUMMARY OF THE INVENTION

The door safety device of this invention has several features, no single one of which is solely responsible for its desirable attributes. Without limiting the scope of this invention as expressed by the claims that follow, its more prominent features will now be discussed briefly. After considering this discussion, and particularly after reading the section entitled "Detailed Description of the Preferred Embodiments," one will understand how the features of this invention provide advantages, which include automatic deployment to a safety position, ease of operation independent of the side of the door upon which the operator is located, and low cost.

The present invention provides a device that prevents the full closure of swinging and sliding doors. The device preferably provides a ⅛" to 3" gap between the door frame and leading edge of the door, and more preferably a ¼" to 1" gap. The device is releasably attached to the door, but remains secured to the door even when the door is closed. The device is gravity actuated, such that when the door is opened, the device automatically deploys to a position wherein it prevents the closure of the door. In order to re-close the door, an operator must manually remove the device to a position where it no longer obstructs the path of the door. Because the device requires the operator to use one hand to hold the device out of the way of the door, and one hand to close the door, the device ensures that both hands are out of harm's way before the door is closed.

The swinging door safety device comprises a pair of parallel flat bars connected to one another at a first end by a crossbar. Near this end, each bar includes a bumper projecting outward laterally. A ring is attached to each bar at a point spaced from the crossbar. Each bar is substantially coplanar with its attached ring, the bar defining a tangent of the ring.

Each ring is adapted to fit around a doorknob With each ring mounted on the oppositely facing knobs on a door, the first end of each bar extends from the leading edge of the door, with the crossbar spanning this leading edge. When the door is open, a counterweight mounted to the end of each bar opposite the bumpers maintains the device in a position wherein the first end of each bar protrudes from the leading edge of the door. In this position the bumpers interfere with the closing of the door by making contact with the door jamb. The bumpers thus prevent full closure of the door. The size of the bumpers determines the size of the gap between the door and the door jamb. This distance is preferably between ⅛" and 3", and more preferably between ¼" and 1".

To close the door all the way, an operator must push up on the counterweights, thereby swinging the bumpers downward and out of the way of the door jamb. In this manner, both hands of the operator are accounted for and out of harm's way. Because of the balance of the device, when the door is reopened, gravity acting on the counterweights automatically swings the device into a position wherein the bumpers prevent full closure of the door.

The sliding door device comprises a mounting bracket including a lever stop. A pivot screw pivotally attaches a lever, comprising a four-sided flat plate, to the mounting bracket. The mounting bracket is positioned near the leading edge of the sliding door, such that when the lever is in a stop position, a portion of the lever protrudes from the leading edge of the sliding door. As the door is closed, this protruding portion contacts the door frame and prevents full closure of the sliding door.

The lever is manually rotatable from the stop position to a retracted position, where it will remain without the need for an operator to hold it. Due to the geometry of the lever, as the door closes the lever contacts the door frame and rotates to a position where gravity biases the lever toward the stop position. Continued contact with the door frame, however, prevents the lever from reaching the stop position. When the door is opened, gravity automatically moves the lever into the stop position.

BRIEF DESCRIPTION OF THE DRAWINGS

The preferred embodiments of this invention, illustrating its features, will now be discussed in detail. These embodiments depict the novel and non-obvious door safety devices of this invention shown in the accompanying drawings, which are for illustrative purposes only. These drawings include the following figures, with like numerals indicating like parts.

DETAILED DESCRIPTION OF THE PREFERRED EMBODIMENTS

Sliding Door Safety Device

Figure 1:
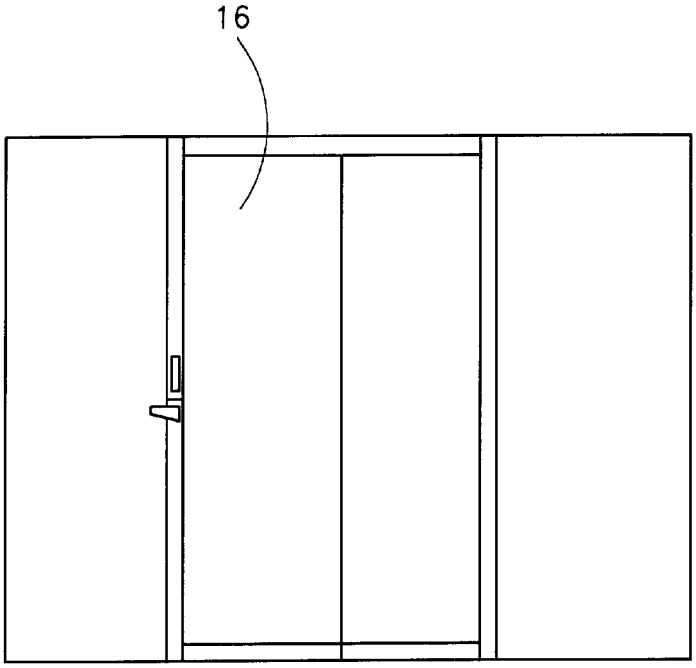
FIG. 1 is a front view of the sliding door child finger saver mounted on a sliding door with the sliding door in an open position.

As illustrated in FIGS. 1–3*b,* the sliding door 16 finger saver device 10 comprises a lever 12 rotatably secured to a mounting bracket 14. The mounting bracket 14 is preferably secured to a surface of a sliding door 16 with adhesive and one or more mounting screws 18. Additional mounting screws, cooperating with additional holes in the bracket 14, may be used to secure the bracket 14 to the door 16. If such additional screws are used, they will preferably lie substantially flush with the bracket surface so as not to interfere with rotation of the lever 12.

The mounting screw 18 preferably includes a portion that protrudes from the mounting bracket surface in order to define the limits of rotation of the lever 12. Alternatively, the screw 18 could be replaced by any protrusion sufficient to limit the rotation of the lever 12. If the screw 18 were so replaced, the bracket 14 would preferably be mounted to the door 16 by at least one other screw.

The device 10 is positioned near the leading edge 20 of the sliding door 16, such that the mounting bracket 14 and lever 12 are substantially parallel with a pane of glass in the sliding door 16. The device 10 is preferably positioned near enough to the door's leading edge 20 that the lever 12 extends ⅛" to 3", and more preferably ¼" to 1", ahead of the leading edge 20 when the lever 12 is in a stop position, seen in FIG. 2. As the door 16 is closed with the lever 12 in this position, the lever 12 contacts the door frame 22 and prevents closure of the sliding door 16.

The mounting bracket 14 is a substantially rectangular flat plate. Although any rigid material can be used to construct the bracket 14, preferred materials are metal, plastic and wood. The bracket 14 includes at least one pivot screw mounting hole 24 for receiving a screw that serves as a pivot for the lever 12. The bracket 14 depicted in the attached figures includes two pivot screw holes 24, only one of which is visible, the other being obscured by the lever 12 and pivot screw 26, as described below.

Figure 2:
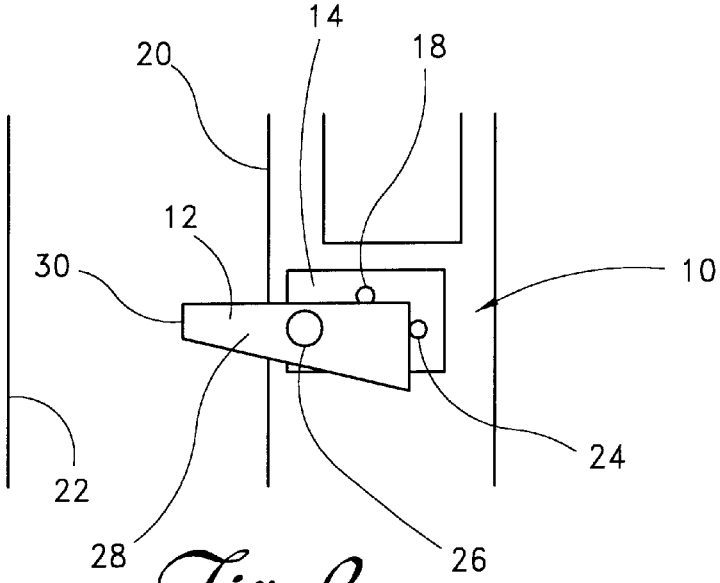
FIG. 2 is a detailed view of the device of FIG. 1, illustrating the device in a stop position.

The provision of two holes enables the device 10 to be mounted on doors that close right to left, as well as doors that close left to right. In FIG. 2, the device 10 is mounted on a door that closes right to left. If the device 10 were to be mounted on a door that closes left to right, the orientation of the bracket 14 would remain the same, but the orientation of the lever 12 would change. The surface of the lever 12 facing the viewer in FIG. 2 would instead face the opposite direction, toward the door 16. The lever 12 would also be mounted to the bracket 14 using the first pivot screw mounting hole 24, seen on the viewer's right in FIG. 2.

There are several possible arrangements for the pivot screw mounting holes 24 and the mounting screw 18. However, because the relative locations of these components contribute to the ability of the lever 12 to properly rotate under the influence of gravity, it is preferred that the mounting screw 18 be located above the pivot screw mounting hole 24 with respect to the ground, and behind the pivot screw mounting hole 24 with respect to the door leading edge 20.

The lever 12, which comprises a four-sided flat plate, is pivotably mounted to the bracket 14 by a pivot screw 26 inserted into the second pivot screw hole 24, which is hidden behind the pivot screw 26 in FIG. 2. The lever 12 is preferably substantially parallel with the bracket 14, and either abutting the bracket 14, or separated from the bracket 14 by a thin bushing (not shown). The lever 12 is substantially rectangular, having one edge 28 that is cut at an angle. This unique shape enables the lever 12 to deploy automatically under the force of gravity to the stop position when the door 16 is opened, as explained below.

The pivot screw 26 is driven through the lever 12 at a point spaced from the lever's center of gravity. Gravity thus biases the lever 12 to rotate toward the stop position, where an edge of the lever 12 contacts the mounting screw 18 and prevents the lever 12 from rotating any further. The lever 12 is rotatable from the stop position, to a retracted position, seen in FIG. 3*b,* where the edge of the lever 12 again contacts the mounting screw 18.

With the lever 12 in the stop position, the sliding door 16 is prevented from closing by the rigid lever 12. As the door 16 is slid shut, a leading edge 30 of the lever 12 contacts the door frame 22, halting further movement of the door 16, and leaving a gap between the frame 22 and door 16. The size of the gap depends upon the size of the lever 12 and the position of the mounting bracket 14 on the door 16, but is preferably between ⅛" and 3", and more preferably between ¼" and 1".

Figure 3A:
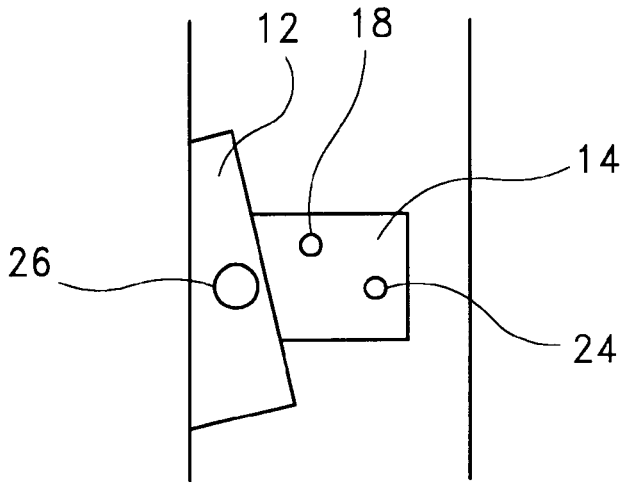
FIG. 3*a* is a detailed view of the device of FIG. 1, illustrating the device in a biased position.
Figure 3B:
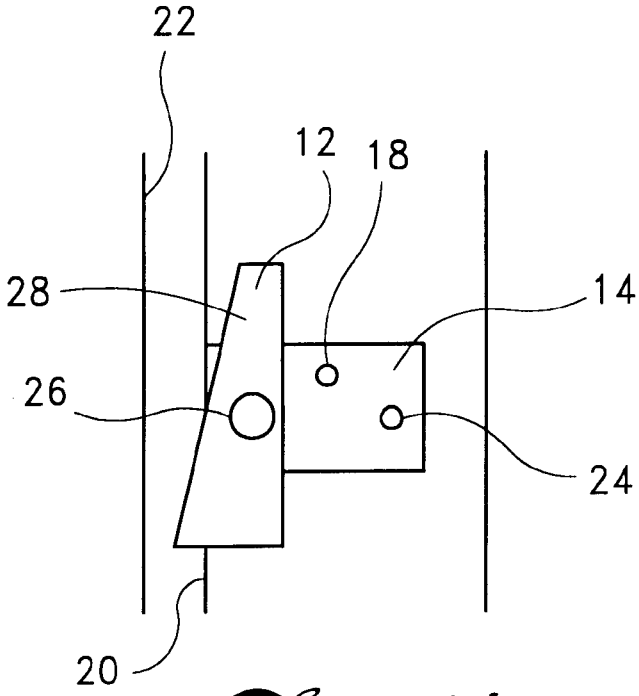
FIG. 3*b* is a detailed view of the device of FIG. 1, illustrating the device in a retracted position.
Figure 4:
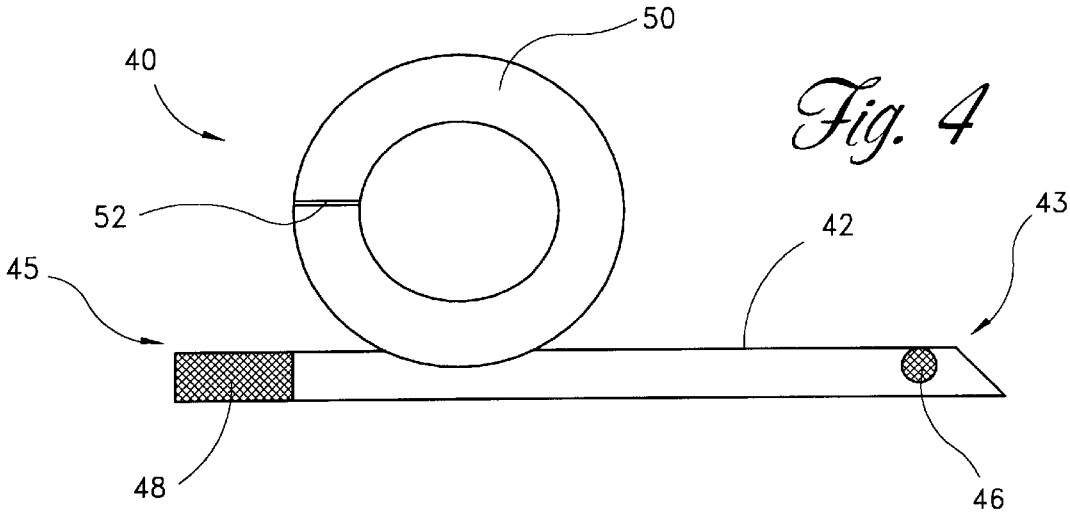
FIG. 4 is a front view of the swinging door child finger saver.
Figure 5:
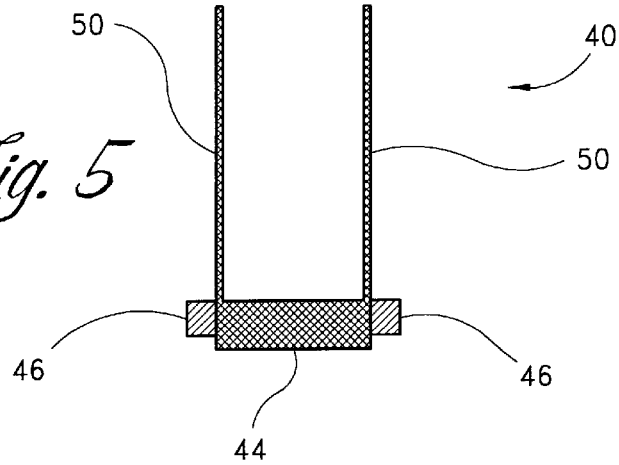
FIG. 5 is a right side view of the device of FIG. 4.

Because gravity biases the lever 12 toward the stop position, it will remain in such position until manually rotated from the stop position to the retracted position of FIG. 3*b.* mass distribution of the lever 12 about its pivot screw 26, coupled with the relative positions of the pivot screw 26 and mounting screw 18, retains the lever 12 in the retracted position. In this position, only a lower portion of the lever 12 extends ahead of the leading edge 20 of the sliding door 16, due to the unique angle cut on the lever 12. Thus, when the door 16 is closed, this lever lower portion contacts the door frame 22 ahead of the leading edge 20 of the door 16. The contact causes the lever 12 to rotate into the position seen in FIG. 3*a* as the door 16 fully closes.

In the position of FIG. 3*a,* gravity biases the lever 12 to rotate into the stop position. Continued contact with the door frame 22, however, prevents the lever 12 from rotating any further. When the door 16 is opened, gravity automatically rotates the lever 12 into the stop position. There is no need for an operator to remember to engage the safety device 10, as with some prior art designs. Further, because the device 10 will remain in the retracted position without assistance, the door 16 can be easily closed even when the operator is standing on the side of the door 16 opposite the safety device 10. There is no need for a person to put his or her fingers in danger by reaching between the door 16 and the frame 22 while closing the door 16 in order to retract the safety device 10. The unique geometry of the device 10 thus provides increased safety.

Swinging Door Safety Device

The swinging door safety device 40, seen in FIGS. 4–6*b,* comprises a pair of parallel flat bars 42 connected to one another at a first end 43 by a crossbar 44. The first end 43 of each bar 42 is preferably cut at an angle of approximately 45 degrees. The bars 42 thus intersect a plane defined by the crossbar 44 at this angle.

For ease of packaging, the intersection of the each bar 42 with the crossbar 44 may include a V-joint. The V-joint enables the device 40 to be bent such that the crossbar 44 is substantially co-planar with the bars 42. In this configuration, the device 40 may be more economically packaged and shipped because it occupies less space within a container. The device 40 would be easily bendable by the consumer for installation.

Near the first end 43, each bar 42 includes a resilient bumper 46 that projects outward laterally. At a second end 45, each bar 42 preferably includes a counterweight 48 that biases the rotation of the device 40 as explained below. A ring 50 is attached to each bar 42 at a point between the first and second ends. Each ring 50 is substantially coplanar with the bar 42 to which it is attached.

Each ring 50 may include a gap 52, enabling the ring 50 to be temporarily deformed to fit over a doorknob. Alternatively, the rings 50 may not include a gap, but may instead be constructed of a material that is capable of stretching to fit over a doorknob. With each ring 50 mounted on the oppositely facing knobs or handles on a door 54, the first end of each bar 42 extends from the leading edge 56 of the door 54, with the crossbar 44 spanning this leading edge 56, as seen in FIGS. 6*a*–6*b*.

Figure 6A:
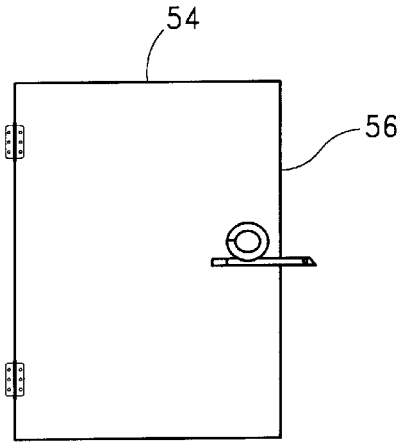
FIG. 6*a* is a front view of the device of FIG. 4 installed on a swinging door, the device being in a stop position.

When the door 54 is open, the force of gravity acting upon the counterweight 48 maintains the device 40 in the position seen in FIG. 6*a,* wherein the bars 42 are substantially parallel to the ground and the first end of each bar 42 protrudes from the leading edge 56 of the door 54. In this position the bumpers 46 interfere with the closing of the door 54 by making contact with the doorjamb (not shown). The bumpers 46 thus prevent full closure of the door 54.

The bumpers 46 are preferably made of a firm but resilient material such as vulcanized rubber. The size of the bumpers 46 determines the size of the gap between the door 54 and the doorjamb. This gap is preferably between ¼" and 1".

Figure 6B:
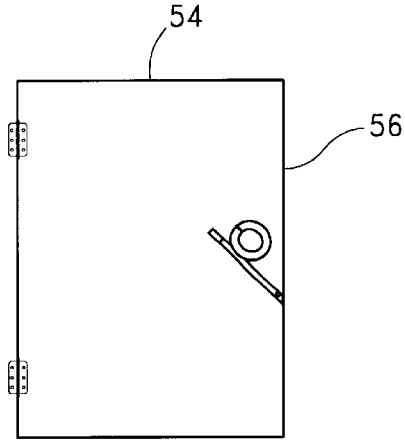
FIG. 6*b* is a front view of the device of FIG. 4 installed on a swinging door, the device being in a retracted position.

To close the door 54 completely, an operator must push up on a counterweight 48, or down on a bumper 46, thereby swinging the bumpers 46 downward and out of the way of the doorjamb, as seen in FIG. 6*b.* Because of the angle at which the crossbar 44 attaches to the bars 42, when the device 40 is swung into the position of FIG. 6*b,* the crossbar 44 lies flat against the leading edge 56 of the door 54 where it does not interfere with the doorjamb.

Because the device 40 must be manually adjusted to a closure position and held there before the door 54 can be closed, both hands of the operator are accounted for and out of harm's way. Because of the balance of the device 40, when the door 54 is reopened, the counterweights 48 automatically swing the device 40 into the position seen in FIG. 6*a,* wherein the bumpers 46 prevent full closure of the door 54. The device 40 is thus safer than prior art designs that require manual deployment of the device to a safety position upon opening the door. Furthermore, because the device 40 wraps around the leading edge 56 of the door 54, the door 54 may be easily closed by an operator standing on either side of the door 54.

The above presents a description of the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A swinging door safety device comprising:

a pair of spaced parallel bars, each having a first end and a second end, the two bars being connected at the first end by a crossbar;

a pair of rings, each ring being co-planar with one of the bars and attached to the bar at a position intermediate of the bar first end and the bar second end; and a pair of bumpers, each bumper protruding laterally outward from one of the bars at a position near the bar first end.

2. The swinging door safety device of claim 1, wherein the bars are attached to the rings such that each bar defines a tangent of the ring to which it is attached.

3. The swinging door safety device of claim 2, wherein each ring includes a gap portion.

4. The swinging door safety device of claim 3, further comprising:

at least one counterweight secured to one of the bar second ends.

* * * * *